US005516228A

United States Patent [19]

Mäantynen

[11] Patent Number: 5,516,228

[45] Date of Patent: May 14, 1996

[54] SPREADING DEVICE FOR A ROAD-CONSTRUCTION MASS SUBSTANCE

[76] Inventor: Esa Mäantynen, Pajulammintie 24, FIN-43100 Saarijärvi, Finland

[21] Appl. No.: 302,706

[22] PCT Filed: Mar. 12, 1993

[86] PCT No.: PCT/FI93/00090

§ 371 Date: Sep. 9, 1994

§ 102(e) Date: Sep. 9, 1994

[87] PCT Pub. No.: WO93/18234

PCT Pub. Date: Sep. 16, 1993

[30] Foreign Application Priority Data

Mar. 13, 1992 [FI] Finland ..... U920215
Jan. 22, 1993 [FI] Finland ..... 930251

[51] Int. Cl.[6] ..... E01C 19/48

[52] U.S. Cl. ..... 404/103; 404/108

[58] Field of Search ..... 404/101, 103, 404/108, 110

[56] References Cited

U.S. PATENT DOCUMENTS 4,725,163 2/1988 Phillips ..... 404/110 X

*Primary Examiner*—William P. Neuder
*Attorney, Agent, or Firm*—C. J. Fildes & Co.

[57] ABSTRACT

The object of the invention is a spreading device (1) for a mass substance used in road construction, which is intended to be used as an accessory to a machine (2) equipped with a lifting boom (35), and which includes a feed silo (22) for the mass to be spread and an opening (17), through which the mass flows onto the road, field, or similar.

The device includes an attachment counterpiece (9) located on a joint (36) at the rear of the device, which permits the spreading device (1) to bend freely when seen from the side, and to which the boom (35) of the machine (2) is attached, support wheels (5) that turn around a vertical joint axle (11) in front of the opening (17), and a roller wheel (6) or other pre-compaction member behind the opening (17) in order to pre-compact the spread mass.

14 Claims, 5 Drawing Sheets

SPREADING DEVICE FOR A ROAD-CONSTRUCTION MASS SUBSTANCE

The object of the invention is a spreading device for a road-construction mass substance, which intended to be used as an accessory to a machine equipped with a lifting boom, and which includes a feed silo for the mass to be spread and an opening through which the mass flows onto a road, field, or similar.

In road construction and basic improvements the spreading of the base course is an important phase of the work. The base course is usually formed of a suitable quality of gravel or crushed rock. Earth concrete is also used. At present the spreading of the base course usually takes place using the scoop of a wheeled loader, the pusher plate of a tracked tractor, or by a spreading device converted from an asphalt-spreading machine, one problem with which is that the layer of crushed material to be spread separates in such a way that the fine material drops to the bottom and the rough material rise to the surface, a consequence of which is an essential weakening of the load-bearing ability of the course in question. In addition, a problem with spreading using a wheeled loader or a tracked tractor is that the success in creating a level surface depends essentially on the skill of the driver, in which case the surface is often unsatisfactory. In the device converted from an asphalt-spreader an additional problem is the expense of the device and that at least two men are needed during spreading.

Various kinds of spreading devices for road materials are known from patent and application publications DE 812677, DE 939749, 2135033(H), and WO 89/01077, as well as from Finnish application 801407 (corresponds to SE 7903901-2). Generally these are towable trailers equipped with support wheels or roller wheels. A problem with towable spreading devices is the fact that trucks bringing the mass to be spread have to drive on top of the previously spread load. The WO publication does not present an ordinary spreading device as such, but a lateral movement device by means of which the mass is moved to the side of the line of driving. In the device in accordance with Finnish patent application 801407 there is a silo and an opening leading from it the rear plate of which limits the thickness of the mass to that desired. The device includes support wheels and skids. The device is advantageously rowed by a wheeled loader, by means of which it can be moved to another place of operation.

The Swedish road administration uses a spreader that grips the rear wheels of the truck that is discharging the mass, and consists mainly of a silo, a height limiter for the opening, as well as support wheels. These devices demand as least two men to operate it.

The intention of the invention is to create a simpler and more easily used spreading device than previous ones, by means of which, however, a precise spreading result can be achieved. In addition, a possibility of a simple adjustment of width and height is desired. In order to realize these the properties presented in the accompanying Patent claims are characteristic of a device in accordance with the invention.

A spreading device in accordance with the invention is pushed, contrarily to many known spreading devices. It is then possible to use any suitable machine, which is equipped with a lifting device. A scoop loader, in which the spreading device is installed in place of the scoop, is especially suitable for this purpose. The operating devices of the spreading device can then advantageously take their operating power from the hydraulic system of the machine. By means of a device in accordance with the invention the spread surface layer is compacted, so that it withstands the weight of the machine. The spreading height is determined by the difference in height between the roller wheels or other pre-compacting device and the support wheels. Other advantages and forms of application of the invention can be seen from the examples of application presented later.

In what follows the invention is described by reference to the accompanying figures, which show various road-construction mass spreading devices in accordance with the invention.

Figure 6:
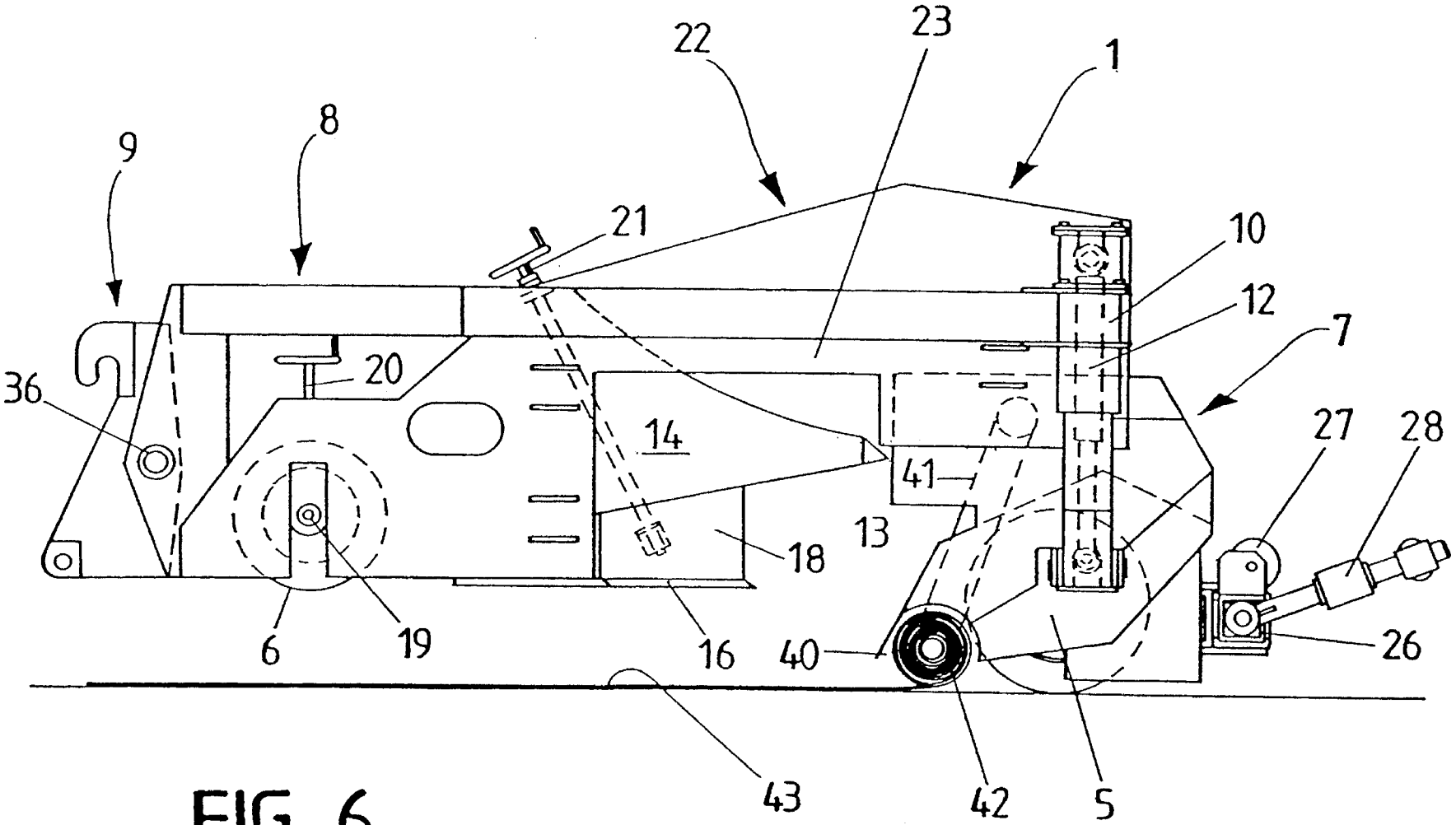

FIG. 6 hows schematically the laying of the plastic net.

Figure 1:
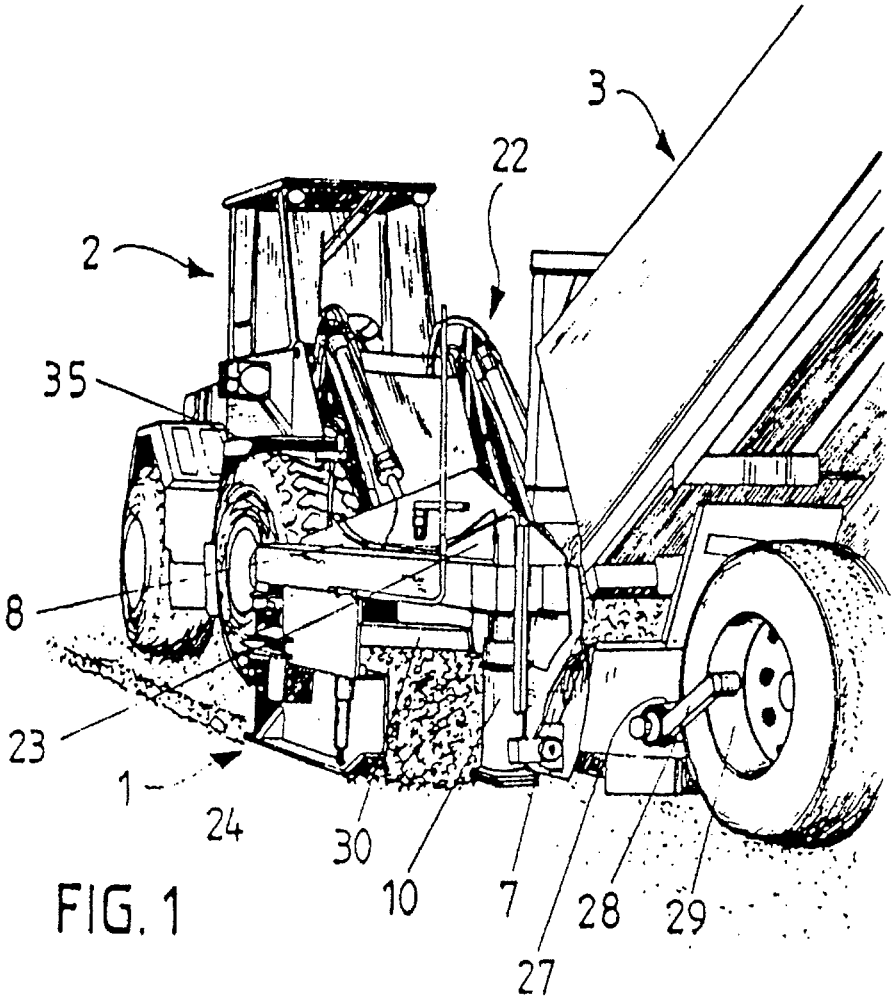
FIG. 1 shows a perspective view of a device for spreading-road-construction mass in accordance with the invention.
Figure 5:
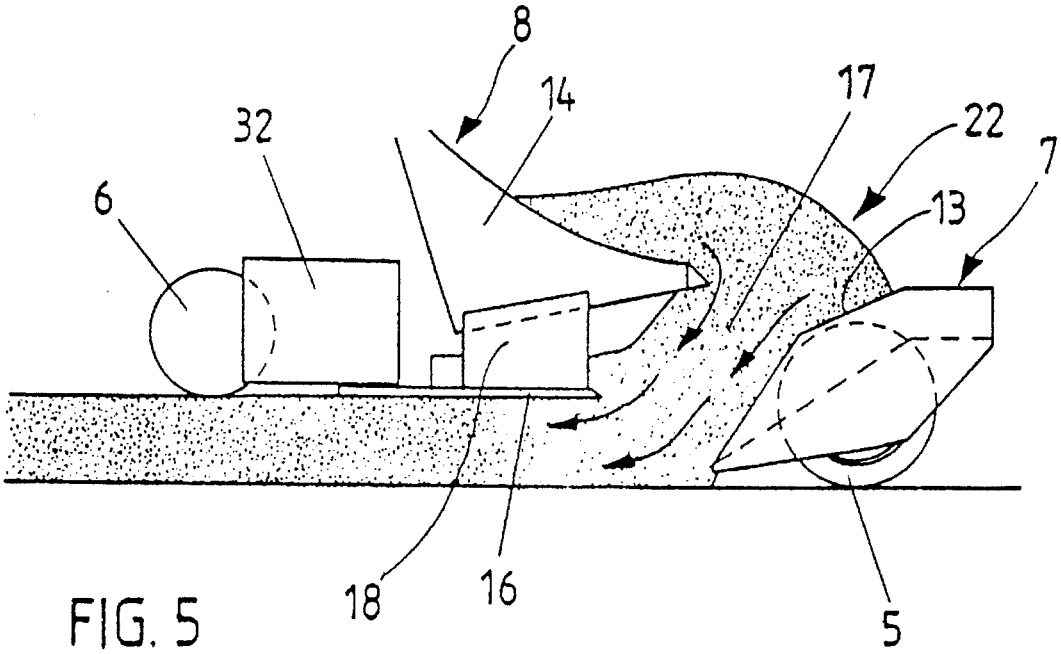
FIG. 5 shows the spreading process in detail.

In accordance with FIG. 1 a scoop loader is advantageously used as the implement 2, to the boom 35 of which the spreading device 1 is attached. The truck 3 discharges the mass to be spread into the silo 22. The wheels 29 of the truck come into contact with the pushing rollers 27 at the front of the spreading device 1 and grip 28 is attached to the rim of wheel 29, by means of which the spreading device can be pulled, if necessary. In accordance with the principal method, however, the machine 2 pushes the spreading device 1 and even pushes the discharging truck 3 forward. The components visible is FIG. 1 are shown later in greater detail.

Figure 2:
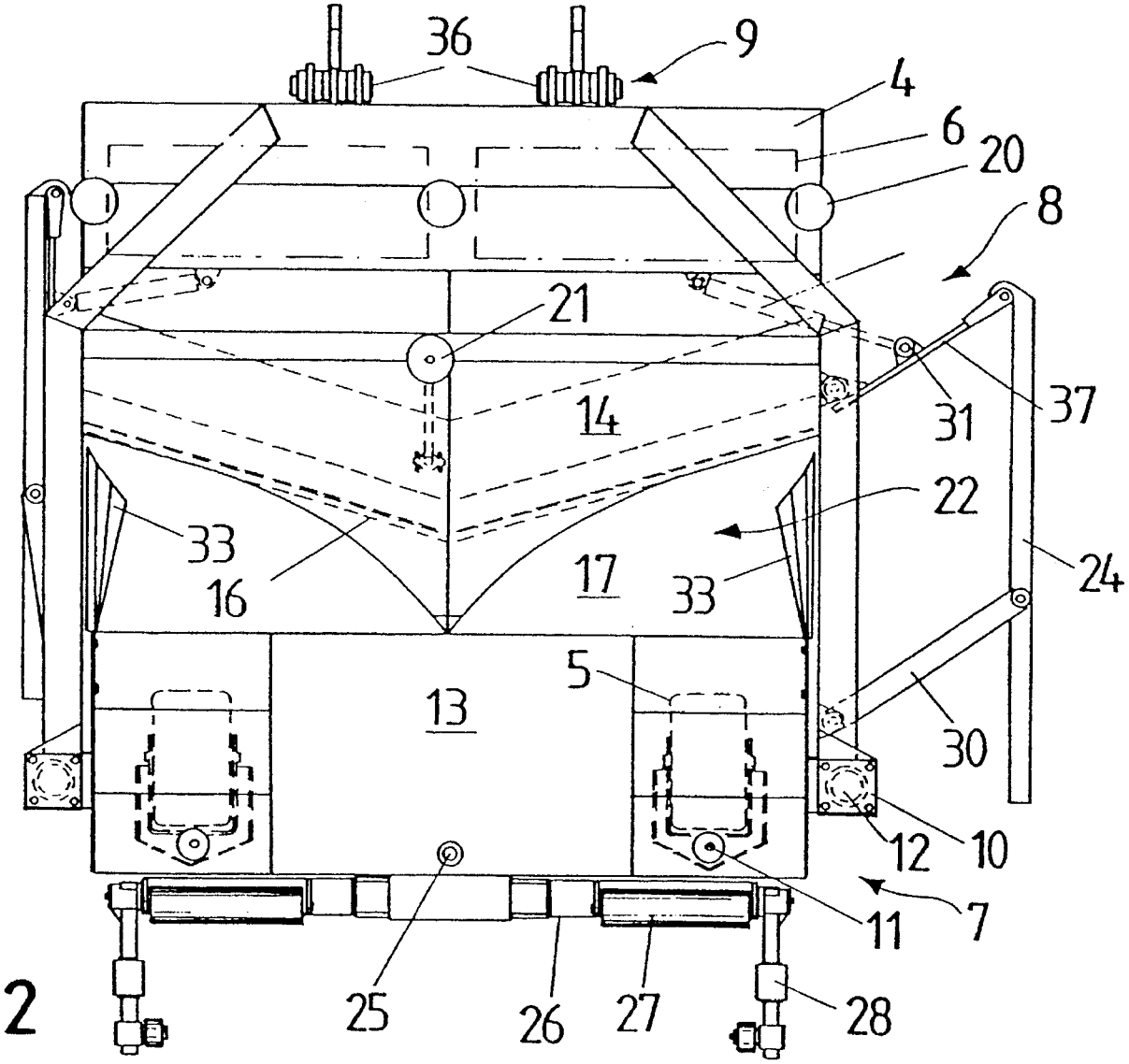
FIG. 2 shows a spreading device seen from above with one side guide extended.

FIG. 2 shows a spreading device seen from above in detail. The machine is attached to attachment lugs 9, which are attached to the frame 4 of the spreading device by means of joint axles 36. With the aid of joint axles 36 the spreading device 1 can bend to a certain extent, when seen from the side. The spreading device 1 includes the front section 7 and the rear section 8, which between them form both the silo 22 and the opening 17. The front section 7 includes support wheels 5 that turn around vertical joint axles 11, the wheels being protected under the front ramp 13. In addition, the pusher beam 26, which is limitedly turnable by means of joint 25, carries pusher rollers 27 and grips 28.

The rear section 8 includes rear ramp 14 as part of the silo and horizontal blade 16 located beneath this, which limits the spreading height. The rear section 8 also includes a two-piece roller wheel 6, the bearings of which can be moved in a vertical direction by means of an adjustment device 20. The rear section 8 includes, at the silo 22, side plates above but leaves an opening below, from which the mass is able to flow outwards, once the side guide 24 is extended to the side. The side guides are attached to the rear section 8 of the frame 4 by means of joint arms 30 and 31, and can be controlled by means of operating device 15. The rear joint arm 31 includes plough plate 32, which limits the spreading height at the side.

The front section 7 and the rear section 8 are attached to one another by means of support member 10, which is here formed by a slide guide operated by hydraulic cylinder 12.

Figure 3:
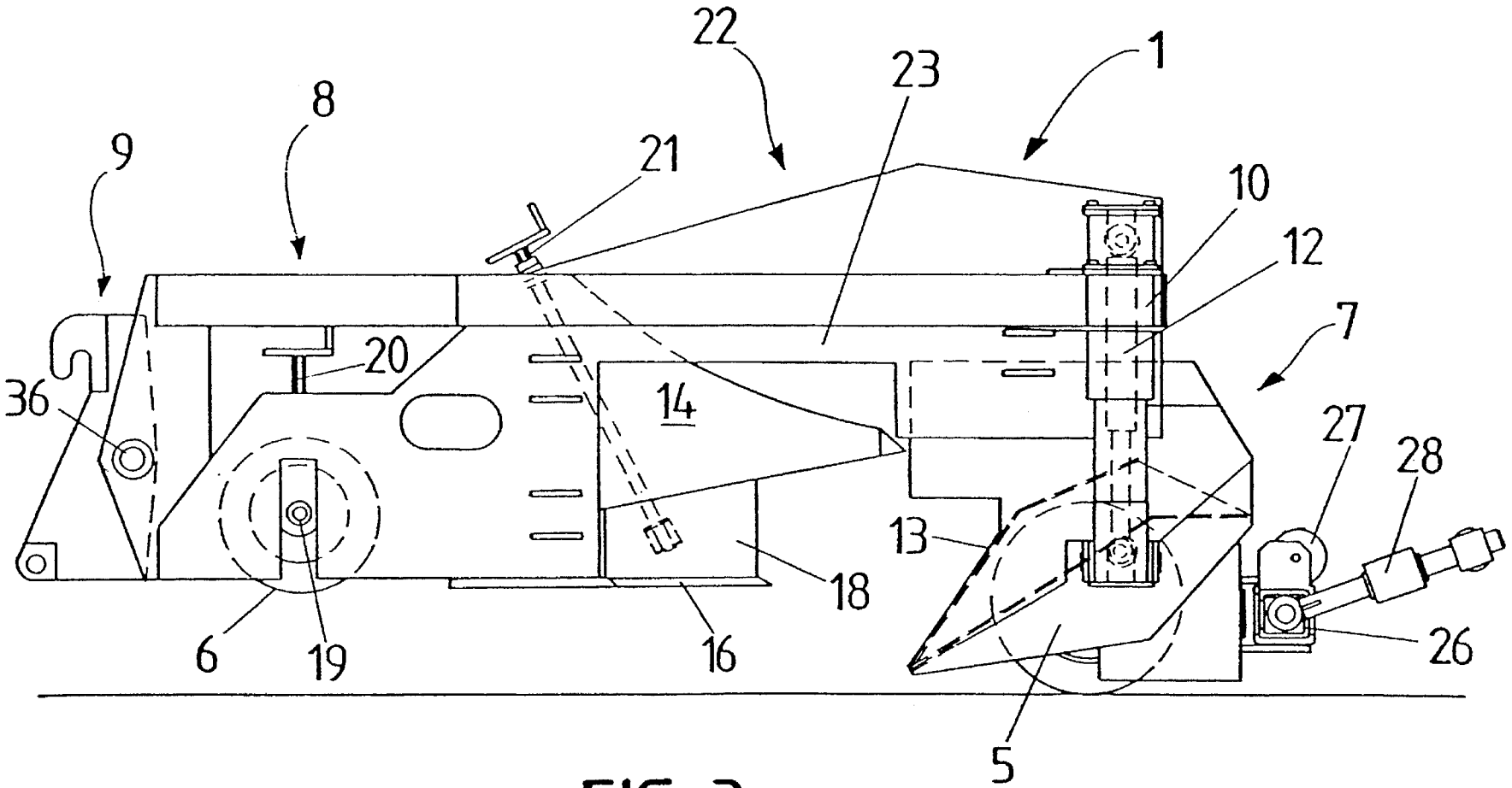
FIG. 3 shows a spreading device seen from the side with the side guide removed.

FIG. 3 shows the aforementioned support member 10 between front section 7 and rear section 8 in greater detail. There is a hydraulic operating device 12 inside this slide guide, by means of which the difference in height between the front and rear sections, and thus the spreading height, can be adjusted as desired. The figure shows how and opening, from which the mass can flow to the sides, remains beneath silo 22, is side plate 24 is extended outwards. In the figure plough plates 18 are also attached on top of the cutting blade 16. In the front section 7 the front ramp 13 extends to nearly the original road surface whereas the rear ramp 14 in the rear section 8 directly the mass strongly forwards, because, however, it is pushed by the effect of movement backwards to the plough plate 18 and blade 16.

At the middle blade 16 and plough plate 18 can be raised by means of adjustment devices 21, when it is possible to lay a thicker layer on the centre line of the road. Correspondingly too the bearings 19 of the roller wheels 6 can be raised at all three points by means of adjusting devices 20, when at the same time the degree of compaction of the spread mass can be adjusted. The spreading device 1 is particularly intended to be used in such a way that the booms of the machine are fixed in the lower position, when the height of the joint 36 of the attachment lugs 9 is completely determined in relation to the spread surface, whereas the support wheels 5 of the front section 7 travel over the unspread surface. The height of the spread is thus determined by the height adjustment of the support member 10, by means of which the blade 16 moves vertically.

Contrary to the figure the blade can be set even directly transversely together with the delimiting vertical wall.

Figure 4:
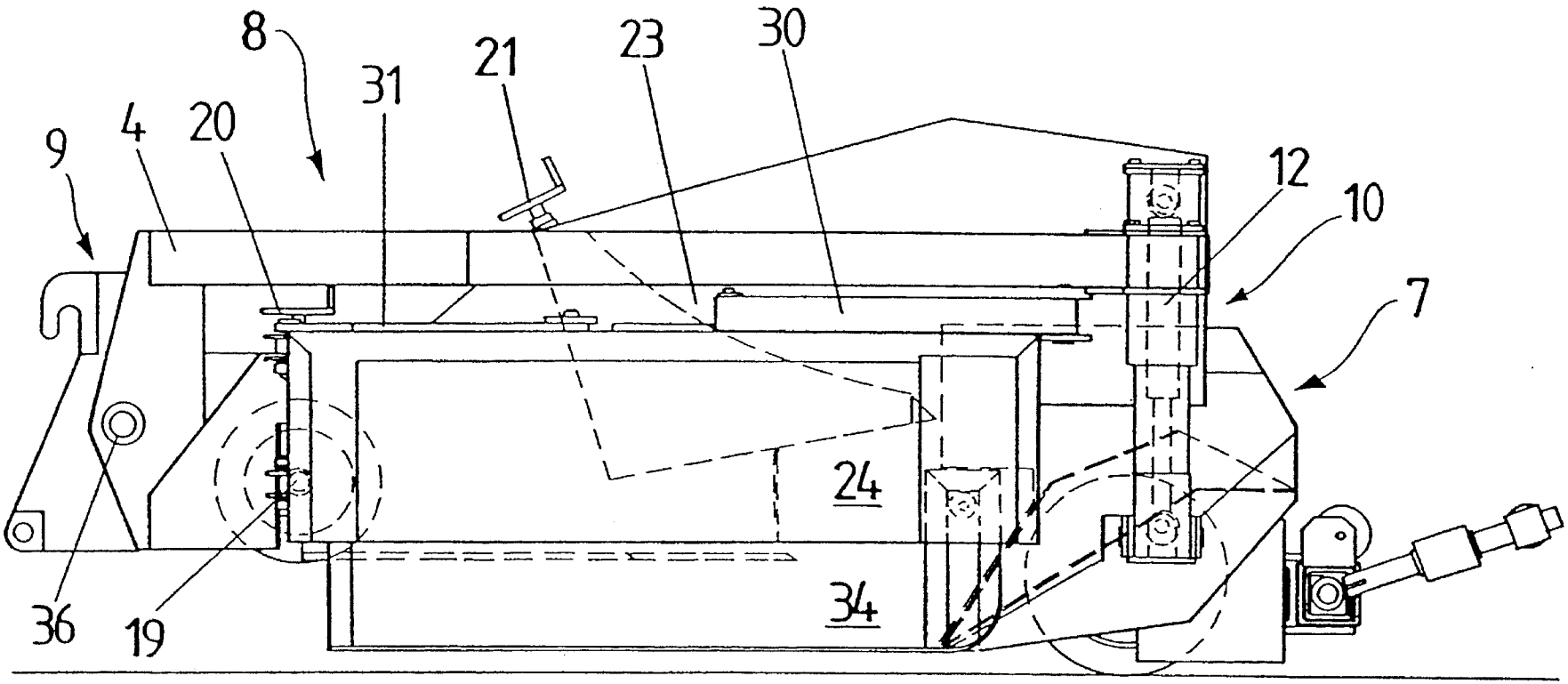
FIG. 4 shows a spreading device seen from the side with the side guide retracted.

FIG. 4 also shows the side guide 24, which also includes lower part 34 that moves vertically, and which settles by gravity at a height in accordance with the base.

During spreading the mass discharging down from the silo 22 formed between the front ramp 13 of the front section 7 and the rear ramp 14 of the rear section 8 is attempted to be placed as quickly as possible into its final position, so that separation does not occur. The mass flows through the opening 17. Part of the mass strikes the plough plate 18, which pushes it sideways from on top of the cutting blade 16, which limits the spreading height. At the side the spreading height is determined by the plough blade 32, which is attached to the rear joint arm. In the centre, the roller wheels 6 compact the material at least in the line of travel of the machine. Otherwise the principle compaction takes place with the aid of a vibrating roller that follows later.

The upper part of the feed silo side opening includes a rolling preventor 33, which consists of a few spread-out bars, which prevent the larger mineral substances from rolling sideways straight off the top of the heap.

The spreading device is operated by hydraulics and the control of the hydraulic devices takes place either manually or automatically. The hydraulic hoses are attached to the hydraulic system of the scoop loader in a known manner by means of instant connectors.

The adjustment of the breadth of the layer spread by the side guides 24 takes place steplessly and independently of other operations. In FIG. 2 the right-hand side breadth regulator is at the minimum breadth and the left-hand side one at the maximum breadth.

If required it is possible to add additional rollers to axle extenders to the sides of the roller wheel in order to increase the rolling width.

A spreading device in accordance with the invention makes a layer of even thickness independently of the height and tilt relations of the machine and spreading device, as long as the preliminary adjustments have been made correctly. In order to adjust the layer thickness it is possible use a rod potentiometer, or ultra-sound or laser devices, in which case the adjustment of the layer thickness or of the height of the surface takes place automatically by means of the machine's own hydraulic system.

According to the most recent information it is advantageous to lay a plastic net, or net in general, which improves the tensile strength of the road foundation. For this purpose the spreading device is equipped with a roll space 40 and roll retainers 41 in accordance with FIG. 6, which include a friction brake to tension the net 43 under the mass to be spread as it runs off the roll 42. It is true that the construction must be slightly altered, but the roll 40 can be located behind support wheel 5 under the front ramp 13. Another alternative is to locate the roll in front of the support wheel and alter the construction of the push rollers and grips.

We claim:

1. A spreading device for a mass substance used in road construction, which is intended to be used as an accessory to a machine containing a lifting boom and a feed silo having an opening through which the mass to be spread flows onto the road, characterized in that the device includes:

an attachment counterpiece located on a joint at the rear of the device, which permits the spreading device to bend freely when seen from the side, and to which the boom of the machine is attachable;

support wheels that turn around a vertical joint axle in front of the opening; and a pre-compaction member behind the opening in order to pre-compact the spread mass.

2. A spreading device in accordance with claim 1, characterized in that it consists in construction of two totalities, which are a rear section including the attachment counterpiece and the pre-compaction member, and a front section including the support wheels, as well as support members adjustable in height between them in order to support the rear section from the front one.

3. A spreading device in accordance with claim 2, characterized in that the support members are formed by vertical slide guides operated by an operating device.

4. A spreading device in accordance with claim 2, characterized in that the opening is formed between a rear ramp belonging to the rear section and a front ramp belonging to the front section.

5. A spreading device in accordance with claim 4, characterized in that the support wheels of the front section are located in a protected position beneath the front ramp.

6. A spreading device in accordance with claim 4, characterized in that the opening is open at the sides beneath the opposing ramps, i.e. the silo, and that the rear section includes, on at least one side, side guides installed on joint booms turnable by an operating device, and in which the rear joint boom includes a ploughing plate in order to level the spreading at the side to the desired height.

7. A spreading device in accordance with claim 6, characterized in that the side guides include lower parts supported by slide guides moving vertically.

8. A spreading device in accordance with claim 4, characterized in that the front ramp extends to nearly the unspread surface, whereas the rear ramp ends in a vertical direction at a distance from the compaction surface of the roller wheel, near to which an essentially horizontal cutting blade is located beneath the rear ramp.

9. A spreading device in accordance with claim 8, characterized in that there is a plough above the cutting blade and which cutting blade and plough are located in a forward-pointing V-position, when seen from above.

10. A spreading device in accordance with claim 8, characterized in that both the roller wheel and the cutting blade are in two parts and that their central section are arranged to be adjustable vertically.

11. A spreading device in accordance with claim 2, characterized in that the support wheels have turnable joint axles and are located in front of their axes, in which case they turn to an angle under the influence of traction.

12. A spreading device in accordance with claim 2, characterized in that the support wheels are located 40–90% closer to the opening than the roller wheel.

13. A spreading device-in accordance with claim 1, characterized in that the device includes retainers for a roll of reinforcing net and a brake member connected to them, which is arranged to run net off the roll and under the mass being spread.

14. spreading device in accordance with claim 13, characterized in that a roll space is arranged for the roll under the front ramp of the front section behind the support wheel into which the roll held by the roll retainers is arranged to fit.

* * * * *